US009212427B2

(12) United States Patent
Schäfer et al.

(10) Patent No.: US 9,212,427 B2
(45) Date of Patent: Dec. 15, 2015

(54) CYANIDE-FREE ELECTROLYTE COMPOSITION, AND METHOD FOR THE DEPOSITION OF SILVER OR SILVER ALLOY LAYERS ON SUBSTRATES

(75) Inventors: Stefan Schäfer, Solingen (DE); Thomas B. Richardson, Killingworth, CT (US)

(73) Assignee: Enthone Inc., West Haven, CT (US)

( * ) Notice: Subject to any disclaimer, the term of this patent is extended or adjusted under 35 U.S.C. 154(b) by 97 days.

(21) Appl. No.: 12/445,049

(22) PCT Filed: Oct. 9, 2007

(86) PCT No.: PCT/EP2007/008780

§ 371 (c)(1), (2), (4) Date: Oct. 13, 2009

(87) PCT Pub. No.: WO2008/043528

PCT Pub. Date: Apr. 17, 2008

(65) Prior Publication Data

US 2010/0044239 A1 Feb. 25, 2010

(30) Foreign Application Priority Data

Oct. 9, 2006 (EP) ..... 06021174

(51) Int. Cl.

*C25D 3/56* (2006.01)
*C25D 3/48* (2006.01)
*C25D 3/46* (2006.01)

(52) U.S. Cl.

CPC ..... *C25D 3/46* (2013.01)

(58) Field of Classification Search

CPC ..... C25D 3/46; C25D 3/64
USPC ..... 205/238, 263; 106/1.26
See application file for complete search history.

(56) References Cited

U.S. PATENT DOCUMENTS

| | | | | |
|---|---|---|---|---|
| 4,126,524 | A | 11/1978 | Hradil et al. | |
| 4,161,432 | A * | 7/1979 | Barclay et al. | 205/288 |
| 4,246,077 | A | 1/1981 | Hradil et al. | |
| 4,461,680 | A * | 7/1984 | Lashmore | 205/104 |
| 5,601,696 | A * | 2/1997 | Asakawa | 205/263 |
| 5,759,381 | A * | 6/1998 | Sakurai et al. | 205/253 |
| 6,197,186 | B1 | 3/2001 | Guhl et al. | |
| 6,210,556 | B1 * | 4/2001 | Toben et al. | 205/253 |
| 6,251,249 | B1 * | 6/2001 | Chevalier et al. | 205/80 |
| 6,998,036 | B2 | 2/2006 | Dietterle et al. | |
| 7,025,867 | B2 * | 4/2006 | Czeczka et al. | 205/159 |
| 7,628,903 | B1 * | 12/2009 | Tsuji et al. | 205/239 |
| 2003/0159938 | A1 * | 8/2003 | Hradil | 205/118 |
| 2004/0188267 | A1 * | 9/2004 | Sakamoto et al. | 205/181 |
| 2005/0183961 | A1 * | 8/2005 | Morrissey | 205/263 |
| 2007/0151863 | A1 * | 7/2007 | Morrissey | 205/263 |

FOREIGN PATENT DOCUMENTS

| | | | | |
|---|---|---|---|---|
| EP | 705919 A1 * | 4/1996 | | C25D 3/46 |
| JP | 10121289 | 5/1998 | | |
| JP | 10121289 A * | 5/1998 | | C25D 3/46 |
| JP | 11021693 | 1/1999 | | |
| WO | 2005083156 A1 | 9/2005 | | |

OTHER PUBLICATIONS

Asakawa et al., "Noncyanide Silver Plating Solution Using Hydantoin and Hydantoin Derivatives", Hyomen Gijutsu (no month, 1999), vol. 50, No. 1, pp. 68-71. Abstract Only.*
Asakawa et al., "Noncyanide Silver Plating Solution Using Hydantoin and Hydantoin Derivatives", Hyomen Gijutsu (no month, 1999), vol. 50, No. 1, pp. 68-71.*
Asakawa et al., "Noncyanide Silver Plating Solution Using Hydantoin and Hydantoin Derivatives", Hyomen Gijutsu, (no month, 1999), vol. 50, No. 1, pp. 68-71.*
European Search Report, EP06021174.5, dated Mar. 20, 2007, 7 pages.
Abstract of JP11021693; Jan. 26, 1999.
Abstract of JP11302893; Nov. 2, 1999.
Abstract of JP6330372; Nov. 29, 1994.
International Search Report, PCT/EP2007/008780, dated Feb. 27, 2009, 6 pages.
Written Opinion, PCT/EP2007/008780, dated Feb. 27, 2009, 6 pages.
International Preliminary Report on Patent Ability, PCT/EP2007/008780, dated Apr. 15, 2009, 7 pages.
Abstract of JP3061393; Mar. 18, 1991.
Abstract of SU724606; Mar. 30, 1980.
Ise, Tatsuhiko et al., "Investigation for alkaline electroplating bath of Sn—Ag alloy using 5,5-dimethylhydantoin", Journal of the Surface Finishing Society of Japan, 1998, vol. 49, No. 12, pp. 1310-1315.
Modern Electroplating, Schlesinger et al. eds., 4th ed., John Wiley & Sons, Inc. 2000, pp. 231-232.
"Non-Cyanide Silver as a Substitute for Cyanide Processes," Chicago Metal Finishers Institute, Chicago, Illinois, Jul. 2002, 30 pages.
Blair, Alan, "Silver Plating" in Metal Finishing Guidebook and Directory, vol. 93, Issue 1, Supplement 1, Jan. 1995, pp. 290, 292, 294, 296, and 297.

* cited by examiner

*Primary Examiner* — Edna Wong
(74) *Attorney, Agent, or Firm* — Senniger Powers LLP

(57) ABSTRACT

The invention relates to a cyanide-free electrolyte composition for depositing a silver or silver alloy layer on a substrate as well as a method for depositing such layers with the help of said cyanide-free electrolyte composition. The electrolyte composition according to the invention comprises at least one silver ion source, a sulfonic acid and/or a sulfonic acid derivative, a wetting agent and a hydantoin. The silver or silver alloy layers deposited from such an electrolyte composition by means of the method according to the invention are dull and ductile.

20 Claims, No Drawings

CYANIDE-FREE ELECTROLYTE COMPOSITION, AND METHOD FOR THE DEPOSITION OF SILVER OR SILVER ALLOY LAYERS ON SUBSTRATES

This application is the U.S. national stage application of International Patent Application No. PCT/EP2007/008780, filed Oct. 9, 2007, and claims the benefit of European Patent Application No. 06021174.5, filed Oct. 9, 2006, the entire disclosures of which are incorporated herein by reference.

The present invention relates to a cyanide-free electrolyte composition for the deposition of a silver or silver alloy layer on a substrate. The present invention also relates to a method for the separation of such layers, using the cyanide-free composition according the invention.

Galvanic electrolyte compositions for the deposition of silver or silver alloy layers are known for both the use in the field of decorative surfaces and in the technical field. It is the usual practice in prior art to employ soluble silver compounds, mostly in the form of cyanide compounds such as potassium silver cyanide or in the form of sulfur-containing complexes like sulfite, thiosulfate or thiocyanate as well as ammonium complexes.

Since such electrolyte compositions known from prior art are normally instable without the addition of further complexing or stabilizing agents, it is the common practice to use excessive amounts of the complexing agents, so that such electrolyte compositions frequently include high concentrations of cyanide, sulfur containing complexing agents or ammonium.

The electrolyte compositions such formed are outstanding by their vast range of application. Cyanidic compositions are stable, but they are toxic and hence environmentally harmful. The potential danger of the remaining ones is lower, but the same tend to be instable. Despite the fact that their potential danger is clearly lower compared to that of cyanides, those which are contained in such electrolyte compositions exhibit an environmental relevancy which cannot be neglected in view of their allergenic potential which may be a risk for people working with these electrolyte compositions.

Conditional on the potential ecological risk, the use of such electrolyte compositions leads to very high costs for the reconditioning or removal of used-up electrolyte compositions. This is a considerable drawback of these electrolyte compositions which are known from prior art.

In view of the above, the intention has been for a long time to provide electrolyte compositions which exhibit as good application properties and coating results as cyanide-containing electrolyte compositions, but which are completely or at least almost free of environmentally harmful compounds.

The document DE 199 28 47 A1 for instance discloses an aqueous electrolyte composition for the galvanic deposition of precious metals and precious metal alloys which ranges between environmentally compatible and free of harmful substances and which contains the precious metal to be deposited and the possible alloying metals to be employed in the form of water-soluble compounds of protein amino acids or the salts thereof or in the form of sulfonic acid compounds. For the stabilizing and complexing of the electrolyte compositions according to DE 199 28 47 A1, the same include water-soluble nitro compounds. The same can be for instance 3-nitrophthalic acid, 4-nitrophthalic acid or m-nitrobenzene sulfonic acid. For further stabilization of the electrolyte compositions the same may include organic acids like nicotinic acid or succinic acid.

From the document U.S. Pat. No. 4,126,524 cyanide-free electrolyte compositions for the deposition of silver or silver alloys are known which include silver in the form of imides of organic dicarbonic acids. For instance, the reaction products from water-soluble silver salts with pyrrolide ions can serve as silvers sources in corresponding electrolyte compositions. Moreover, silver can be used in the form succinimides or maleimides.

Also the U.S. Pat. No. 4,246,077 discloses the use of silver in the form of pyrrolidindions as a silver source in corresponding electrolyte compositions for the deposition of silver and silver alloy layers.

The U.S. Pat. No. 5,601,696 discloses the use of hydantoin as complexing reagent in electrolyte compositions for the deposition of silver or silver alloy layers on substrates. Here, 1-methylhydantoin, 1,3-dimethylhydantoin, 5,5-dimethylhydantoin, 1-methanol-5,5-dimethylhydantoin or also 5,5-diphenylhydantoin can be employed for instance as complexing reagents. A deposition of mirror-shining silver and silver alloy layers from such electrolyte compositions is however not possible. But this is desired particularly in the field of decorative surface coating.

The WO 2005/083156 discloses a hydantoin-containing electrolyte composition for the deposition also of mirror-shining silver or silver alloy layers. But these electrolyte compositions include other environmentally harmful compounds such as for example 2,2'-bipyridin. 2,2'-bipyridin can result in an inhibition of the carboxypeptidases which play a decisive part in the digestion of protein in the small intestine, which accounts for the toxicity of the class of compounds and requires utmost care at the handling of these compounds.

In view of this prior art, the present invention is based on the object of providing an improved cyanide-free electrolyte composition with which it is possible to deposit crack-free and ductile silver or silver alloy layers and which is also free of harmful compounds. The present invention is further based on the object of providing a corresponding method for the deposition of such layers, using the electrolyte composition according to the invention.

Concerning the electrolyte composition, this object is solved by a cyanide-free electrolyte composition for the deposition of a silver or silver alloy layer on a substrate which contains at least one silver ion source, a sulfonic acid and/or a derivative of a sulfonic acid, a wetting agent as well as a hydantoin having the general formula

4

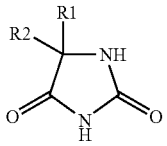

wherein $R_1$ and $R_2$ can independently be H, an alkyl group having 1 to 5 carbon atoms or a substituted or unsubstituted aryl group.

The electrolyte composition according to the invention includes the sulfonic acid and/or a derivative of a sulfonic acid at a concentration between 50 g/l and 500 g/l, preferably between 100 g/l and 300 g/l, still more preferably between 130 g/l and 200 g/l. Preferably, the electrolyte composition according to the invention includes potassium methane sulfonate.

In addition to potassium methane sulfonate other methane sulfonates like for instance sodium methane sulfonate are suited, but also sulfates and other compounds suitable as a conductive salt for use in the electrolyte composition according to the invention.

The electrolyte composition according to the invention can have a silver concentration between 10 to 50 g/l, preferably between 20 and 40 g/l, still more preferably between 25 and 35 g/l.

As a silver ion source the electrolyte composition according to the invention includes at least one silver salt of a sulfonic acid.

In addition to that, as further silver ion sources inorganic silver salts which are selected from group consisting of silver oxide, silver nitrate and silver sulfate can be contained in the electrolyte composition.

For the deposition of silver alloy layers the electrolyte composition according to the invention can include corresponding sources for alloying metal ions. Preferably, corresponding alloying metals are employed in the form of their sulfonic acid salts, oxides, nitrates or sulfates.

As a wetting agent the electrolyte composition according to the invention can include for instance a naphthalin sulfonic acid formaldehyde polycondensat and/or a sulfopropylized polyalkoxylized naphthol. Moreover, the electrolyte composition can include additional wetting agents or surfactants.

In addition to that, also an alkali bromide can be added to the electrolyte composition, for improving the deposition result. The addition of potassium bromide turned out to be particularly suitable. The addition of alkali bromides, especially potassium bromide, results in a uniform deposition of the silver layer on the substrate surface. Particularly at the deposition of dull layers the addition of potassium bromide results in a uniform dull effect of the deposited layer. Moreover, concerning the color, more uniform deposition results are obtained by the addition of alkali bromides such as e.g. potassium bromide. According to the invention, 50 to 500 mg/l of alkali bromide, preferably 100 to 200 mg/l of alkali bromide, can be provided for obtaining the above-described improved deposition results. The thus deposited layers are almost free of internal stress and exhibit very good soldering properties.

In one embodiment the electrolyte composition according to the invention includes a thiosulfate. Preferably, in such an embodiment the electrolyte composition includes an alkali thiosulfate, even more preferably sodium thiosulfate. The thiosulfate is contained in the electrolyte composition at a concentration between 50 mg/l and 500 mg/l, preferably 100 mg/l to 200 mg/l. Here, the thiosulfate does not serve as complex forming agent for the silver to be deposited, but it serves as a matting agent. The silver layers deposited from such an electrolyte composition are uniformly dull and almost free of internal stresses. They additionally exhibit excellent soldering properties.

In a further embodiment of the electrolyte composition the same includes both an alkali bromide and a thiosulfate. Here, the total concentration of alkali bromide and thiosulfate in the electrolyte composition is 50 mg/l to 500 mg/l, preferably 100 mg/l to 200 mg/l. Also the layers deposited from such an electrolyte composition are dull, almost free of stresses and exhibit very good soldering properties.

The pH value of the electrolyte composition according to the invention is between pH 8 and pH 14, preferably between pH 9.0 and pH 12.5, still more preferably between pH 9.5 and pH 12.0.

Concerning the method, the problem is solved by a method for the deposition of a silver or silver alloy layer on a substrate, wherein the substrate to be coated is contacted with the electrolyte composition in accordance with the invention at a set current density between 0.1 and 2 A/dm$^2$, preferably 0.3 to 1.5 A/dm$^2$.

The cyanide-free electrolyte compositions according to the invention exhibit stability to an extent that has been unknown up to present for cyanide-free silver deposition electrolytes, which stability is comparable to the stability of cyanidic baths. So the electrolyte compositions according to the invention exhibit a bath stability of ≥100 Ah/l. Consequently, the electrolyte compositions according to the invention can be employed in corresponding silver deposition baths having a lifetime of more than one year, which fact results in considerable advantages concerning costs and environment pollution as compared over cyanide-free electrolyte compositions known from prior art.

With the electrolyte composition and the method according to the invention the deposition of shiny, ductile silver or silver alloy layers is possible in a vast range of application. Layers can be deposited for instance for use in the jewelry, electronic or automotive industries with the aid of the electrolyte composition according to the invention.

The method and the electrolyte composition according to the invention can be especially applied on suitable substrates like gold-plated, nickel-plated and further metal sheets not showing a tendency to dissolution of the metal in the bath.

EXAMPLE 1

A gold-plated brass sheet was contacted at a set current density of 0.5 A/dm$^2$ for 15 minutes with an electrolyte composition which had the following composition:

30 g/l Ag as silver methane sulfonate (Ag-MSA)
150 g/l potassium methane sulfonate
80 g/l 5,5-dimethylhydantoin
15 g/l naphthalene sulfonic acid formaldehyde polycondensate
2.5 g/l sulfopropvlized polyalkoxylized naphthol as potassium salt A uniform shining silver layer of 5 μm was deposited.

EXAMPLE 2

A gold-plated brass sheet was contacted at a set current density of 0.5 A/dm$^2$ for 15 minutes with an electrolyte composition which had the following composition:

35 g/l Ag as silver methane sulfonate (ag-MSA)
150 g/l potassium methane sulfonate
120 g/l 5,5-dimethylhydantoin
20 g/l naphthalene sulfonic acid formaldehyde polycondensate
150 mg/l potassium bromide A uniform dull silver layer of 3 μm was deposited. The layer was stress-free and exhibited good soldering properties.

EXAMPLE 3

A gold-plated brass sheet was contacted at a set current density of 0.5 A/dm$^2$ for 15 minutes with an electrolyte composition which had the following composition:

35 g/l Ag as silver methane sulfonate (Ag-MSA)
150 g/l potassium methane sulfonate
120 g/l 5,5-dimethylhydantoin
20 g/l naphthalene sulfonic acid formaldehyde polycondensate
150 mg/l sodium thiosulfate A uniform dull silver layer of 3 μm was deposited. The layer was stress-free and exhibited good soldering properties.

EXAMPLE 4

A gold-plated brass sheet was contacted at a set current density of 0.5 A/dm$^2$ for 15 minutes with an electrolyte composition which had the following composition:

35 g/l Ag as silver methane sulfonate (Ag-MSA)
150 g/l potassium methane sulfonate
120 g/l 5,5-dimethylhydantoin
20 g/l naphthalene sulfonic acid formaldehyde polycondensate
75 mg/l potassium bromide
75 mg/l sodium thiosulfate A uniform dull silver layer of 3 μm was deposited. The layer was stress-free and exhibited good soldering properties.

The invention claimed is:

1. A method for electrolytic deposition of a silver or a silver alloy layer on a substrate comprising, contacting the substrate with an electrolyte composition in the presence of an applied current having a current density between 0.1 and 2.0 A/dm$^2$ to thereby deposit the silver or silver alloy layer wherein said layer has a uniform dull appearance;

wherein the electrolyte composition is cyanide-free and comprises:

Ag in a concentration between 10 and 50 g/L as silver methane sulfonate (Ag-MSA);

potassium methane sulfonate in a concentration of 50 to 500 g/L;

a wetting agent;

potassium bromide in a concentration between 50 and 200 mg/L; and a hydantoin of the formula

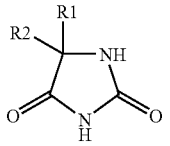

where R1 and R2 are independently H, an alkyl group having 1 to 5 carbon atoms or a substituted or unsubstituted aryl group;

wherein the electrolyte composition has a pH between 8 and 14 and a bath stability of greater than or equal to 100 Ah/L; and wherein the electrolyte composition has a bath life of more than a year.

2. The method of claim 1 wherein the electrolyte composition consists essentially of the Ag as Ag-MSA, the potassium methane sulfonate, the wetting agent, the potassium bromide, and the hydantoin.

3. The method of claim 2 wherein the hydantoin is 5,5-dimethylhydantoin.

4. The method of claim 2 wherein:

the Ag has a concentration between 20 and 40 g/L;

the potassium methane sulfonate has a concentration between 100 and 300 g/L; and the potassium bromide has a concentration between 100 and 200 mg/L.

5. The method of claim 1 wherein the hydantoin is 5,5-dimethylhydantoin.

6. The method of claim 1 wherein the electrolyte composition further comprises an inorganic silver salt selected from the group consisting of silver oxide, silver nitrate, and silver sulfate.

7. The method of claim 1 wherein the pH is between 9 and 12.5.

8. The method of claim 1 wherein the pH is between 9.5 and 12.

9. The method of claim 1 wherein the potassium methane sulfonate has a concentration between 100 and 300 g/L.

10. The method of claim 1 wherein the electrolyte composition comprises:

30 g/l Ag as silver methane sulfonate (Ag-MSA)
150 g/l potassium methane sulfonate
120 g/l 5,5-dimethylhydantoin
20 g/l wetting agent
150 mg/L potassium bromide.

11. The method of claim 1 wherein the electrolyte composition further comprises sodium thiosulfate.

12. The method of claim 11 wherein the electrolyte composition comprises:

35 g/l Ag as silver methane sulfonate (Ag-MSA)
150 g/l potassium methane sulfonate
120 g/l 5,5-dimethylhydantoin
20 g/l wetting agent
75 mg/L sodium thiosulfate
75 mg/L potassium bromide.

13. The method of claim 11 wherein the electrolyte composition consists essentially of:

35 g/l Ag as silver methane sulfonate (Ag-MSA)
150 g/l potassium methane sulfonate
120 g/l 5,5-dimethylhydantoin
20 g/l wetting agent
75 mg/L sodium thiosulfate
75 mg/L potassium bromide.

14. The method of claim 11 wherein the sodium thiosulfate has a concentration between 100 and 200 mg/L.

15. The method of claim 14 wherein the electrolyte composition comprises:

35 g/l Ag as silver methane sulfonate (Ag-MSA)
150 g/l potassium methane sulfonate
120 g/l 5,5-dimethylhydantoin
20 g/l wetting agent
150 mg/L sodium thiosulfate.

16. The method of claim 14 wherein the electrolyte composition consists essentially of:

30 g/l Ag as silver methane sulfonate (Ag-MSA)
150 g/l potassium methane sulfonate
120 g/l 5,5-dimethylhydantoin
20 g/l wetting agent
150 mg/L potassium bromide.

17. The method of claim 14 wherein the electrolyte composition consists essentially of:

35 g/l Ag as silver methane sulfonate (Ag-MSA)
150 g/l potassium methane sulfonate
120 g/l 5,5-dimethylhydantoin
20 g/l wetting agent
150 mg/L sodium thiosulfate.

18. The method of claim 11 wherein the total concentration of potassium bromide and sodium thiosulfate is between 50 and 500 mg/L.

19. The method of claim 1 wherein the electrolyte composition comprises the potassium bromide in a concentration between 100 and 200 mg/L.

20. The method of claim 1 wherein the wetting agent comprises naphthalene sulfonic acid formaldehyde polycondensate.

* * * * *